United States Patent [19]

Skibsted

[11] Patent Number: 4,571,825

[45] Date of Patent: Feb. 25, 1986

[54] RAILROAD TRACK REMOVING APPARATUS

[76] Inventor: Eric T. M. Skibsted, Box 696, Rosebud, Canada, T0J 2T0

[21] Appl. No.: 632,797

[22] Filed: Jul. 20, 1984

[51] Int. Cl.[4] ..... B23P 19/00; E01B 29/02; E01B 27/17

[52] U.S. Cl. ..... 29/823; 104/2; 104/7

[58] Field of Search ..... 104/7 R, 2, 3; 414/745, 414/747; 198/624, 780–784; 29/822–824

[56] References Cited

U.S. PATENT DOCUMENTS

| | | | |
|---|---|---|---|
| 3,274,952 | 9/1966 | Fekete | 104/7 |
| 3,299,833 | 1/1967 | Stewart | 104/7 R |
| 3,424,101 | 1/1969 | Streibel et al. | 104/7 R |
| 3,526,312 | 9/1970 | Braas | 198/624 |
| 4,307,667 | 12/1981 | Scheuchzer et al. | 104/2 |

FOREIGN PATENT DOCUMENTS

| | | | |
|---|---|---|---|
| 719469 | 10/1965 | Canada | 104/4 |
| 959708 | 12/1974 | Canada | 104/6 |
| 356700 | 9/1931 | United Kingdom | 104/3 |

*Primary Examiner*—Howard N. Goldberg
*Assistant Examiner*—Steven Nichols
*Attorney, Agent, or Firm*—Hayes Davis & Soloway

[57] ABSTRACT

The present invention provides an apparatus for removing railroad track, comprising an elongated frame arranged to straddle a pair of rails and having elongated skids arranged to sit upon and slide along the ends of ties secured to the rails on the outboard sides of the rails, a rail and tie separating assembly mounted on the frame for separating lengths of rail from the ties to which the lengths of rail are secured, a rail elevating assembly for lifting lengths of rail which has been separated by the rail and tie separating assembly, and a conveyor for receiving a length of rail lifted by the elevating assembly and longitudinally transporting the rail to one end of the frame.

20 Claims, 14 Drawing Figures

RAILROAD TRACK REMOVING APPARATUS

The present invention relates to an apparatus for removing abandoned railroad tracks.

BACKGROUND OF THE INVENTION

Railroad companies periodically remove railroad tracks which have been abandoned and are no longer in use. Up to the 1970's, the method employed was to engage a crew of men to remove approximately 90% of the spikes which secure the rails to wooden rail ties. The crew was followed by a track mounted crane and a flatcar. Starting at the remote end of the track, a crew of men would remove the remaining spikes, together with joint barrs and rail anchors, from each rail to thus free the rail which could then be lifted by the crane onto the flatcar. A further follow-up crew would remove and haul fastening materials using bucket loaders and dump trucks and a final clean-up crew would collect the ties.

In the mid 1970's, when considerably more track abandonment occured, railroad companies contracted private companies to remove abandoned lines. Most private companies employed a sled-type wedge which was drawn between the rails and the ties. About 90% of the spikes could be removed by this apparatus. The remaining spikes were removed manually. With the rails now freed from the ties, temporary stock pile areas for the rail would be selected, usually at road crossings, and a joint barr would be removed midway between two temporary stock pile areas thus leaving two strings of connected rail approximately one-half mile long. Joint barrs would then be removed, freed rails placed to the side of the track and individually drawn, using any of a variety of appropriate power equipment, to its respective stock pile area. This procedure would continue until all rails of both strings were disconnected and piled. The rail and materials at the temporary stock pile areas were later transported to a main stock pile site. Spikes, tie plates and rail anchors were collected by means of a bucket loader and placed on a dump truck for transport to the main stock pile site. The wooden ties were removed by means of tracked or rubber-tired vehicles which would scoop up the ties from the track bed. Ties are usually embedded in old ballast and wet dirt and, thus, undesirable foreign material would become part of the tie transport load and would restrict payload. The foreign material would remain with the ties and create a hindrance at the stock yard in that it would necessitate an extensive cleanup operation after grading of the ties had been completed.

In the latter method, all material was handled by truck and, as a result, roads would sustain considerable damage. In addition, the sled-type wedge would bend or twist a percentage of rail.

Thus, the rail removing methods and apparatus employed heretofore were labour and equipment intensive, and therefore costly, caused considerable road damage, resulted in a percentage of bent or twisted rails and loss of material (spikes, tieplates, rail anchors, bolts and the like) due to agitation of the track bed while different materials were being collected at different times and created environmental hazards.

SUMMARY OF THE INVENTION

The present invention seeks to provide a railroad track removing apparatus which requires only a relatively small crew, which enables the removal of all steel components at the same time by rail, thus eliminating the need of trucks and loaders and the resulting road damage and inconvenience to the general public, and which removes rails without bending or twisting of the rails.

In general, the present invention provides an apparatus for removing railroad track, comprising an elongated frame arranged to straddle a pair of rails and having elongated skids arranged to sit upon and slide along the ends of ties secured to the rails on the outboard sides of the rails, a rail and tie separating means mounted on the frame for separating lengths of rail from the ties to which the lengths of rail are secured, a rail elevating means for lifting lengths of rail which have been separated by the rail and tie separating means, and a conveyor for receiving a length of rail lifted by the elevating means and longitudinally transporting the rail to one end of the frame.

BRIEF DESCRIPTION OF THE DRAWINGS

These and other features of the invention will become more apparent from the following description in which reference is made to the appended drawings wherein.

DETAIL DESCRIPTION OF A PREFERRED EMBODIMENT

Figure 2:
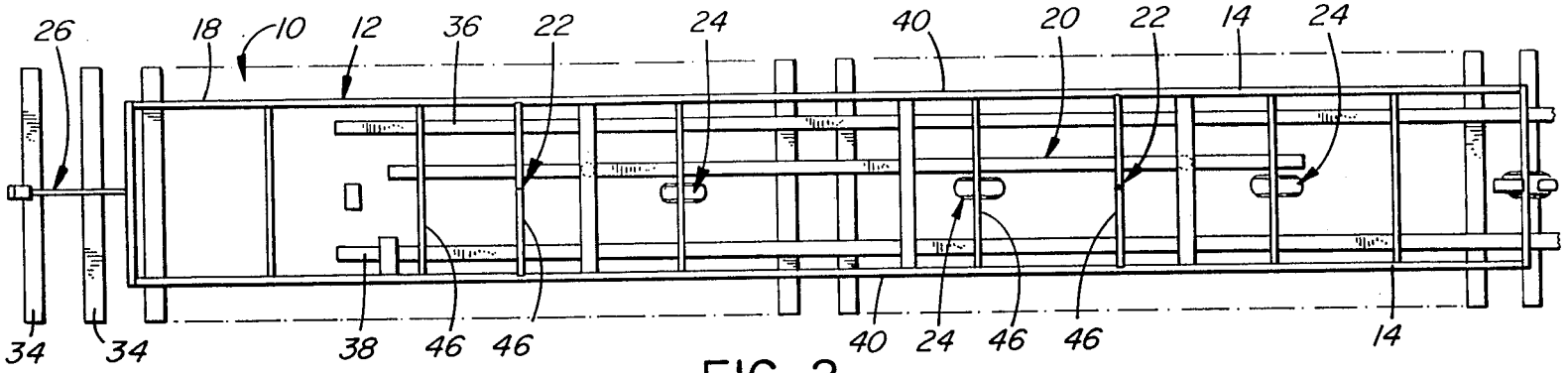
FIG. 2 is a top view of the apparatus of FIG. 1.

The rail removing apparatus of the present invention is generally designated by reference numeral 10 in FIGS. 1 and 2 to which reference will now be made. The apparatus includes an elongated, generally inverted U-shaped frame 12, the forward end 14 of which is arranged to be detachably coupled to a conventional flatcar 16. The length of the frame is somewhat longer than the length of a rail for reasons which become clearer later. The frame includes a pair of longitudinal skids 32 which sit upon the ends of the ties on the outboard sides of a pair of rails to be removed and, thus, in addition to providing a support for various sub-assemblies described below, the frame serves to hold the ties in position while their associated rails are lifted. The skids allow the frame to be towed along the track. The flat car is equipped to receive and store detached rails, in a manner explained later, and with bins to store other detached hardware such as spikes and tieplates. The flatcar is drawn by a conventional locomotive (not shown). Another flatcar (not shown) is coupled to and pushed by the front end of the locomotive for receiving joint barrs, joint barr bolts, and rail anchors.

Mounted on the frame are a rail and tie separating apparatus 20 for separating rails from their associated ties, a rail elevating apparatus 22 for lifting a detached rail, a detached rail conveyor 24 for receiving a detached rail from the rail elevating apparatus and conveying it forwardly to the flatcar and a tie dislodging apparatus 26 secured to the trailing end 18 of the frame for dislodging and overturning ties to allow them to dry. Power equipment, including an engine, hydraulic motors, winches and an operator's seat and controls, generally designated by reference numeral 28, is disposed at the trailing end 18 of the frame.

While each of the above referenced sub-assemblies is described in greater detail below, it will be useful to explain the mode of operation of the apparatus at this point. The apparatus together with a crew of four men are transported to the farthest point of the track to be removed. Joint barrs and anchor plates are removed from the first rails to be removed and are placed in the flatcar ahead of the locomotive. The frame is positioned with its skids on the ends of the ties on the outboard sides of the rails to be removed. The rail and tie separating apparatus 20, which is movable transversely of the track, is first positioned over and secured to one of the rails to be removed and the rail is pulled upwardly against the weight of the frame and the components mounted thereon. Once the rail has been separated from its ties, apparatus 20 is moved laterally inwardly and caused to drop the rail midway on the ties and moved laterally over to the other rail which is gripped and removed in the manner described above. All of the spikes are removed in this manner.

Meanwhile, the rail elevating apparatus 22 is attached to the first rail by a workman and the rail is raised until it seats in conveyor 24. Simultaneously, other workmen collect tie plates and spikes which have been removed and place them in appropriate bins in flatcar 16. The elevating apparatus is released and the conveyor is actuacted whereby the rail is conveyed longitudinally forwardly to the waiting flatcar. The three sub-assemblies operate simultaneously. When the two transversely adjacent lengths of rail have been removed in this manner, the frame is towed forwardly until it is in a position to remove two other adjacent lengths of rail. As the frame is being towed, tie dislodging apparatus 26 grips, dislodges and overturns the ties and leaves them to dry on top of the trackbed for ultimate collection by another crew. While the rails are being removed, one workman, ahead of the locomotive, removes joint barr bolts from the next pair of rails to be removed and two other workmen collect the barrs, bolts and plates and place them in the leading flatcar.

Figure 1:
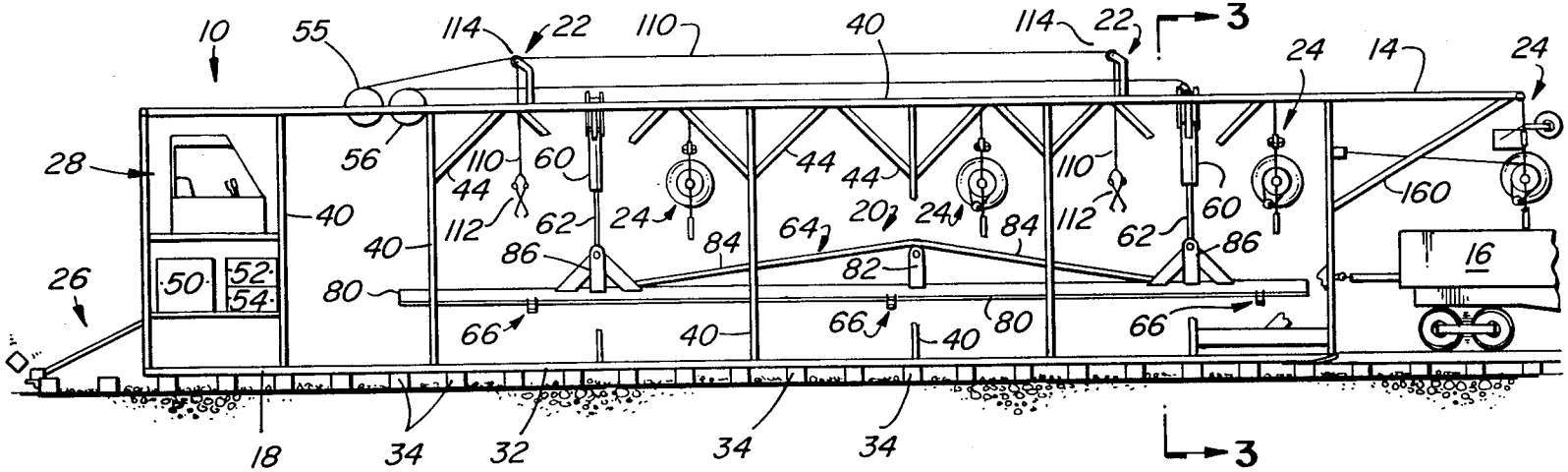
FIG. 1 is a side elevational view of the rail removing apparatus of the present invention.
Figure 3:
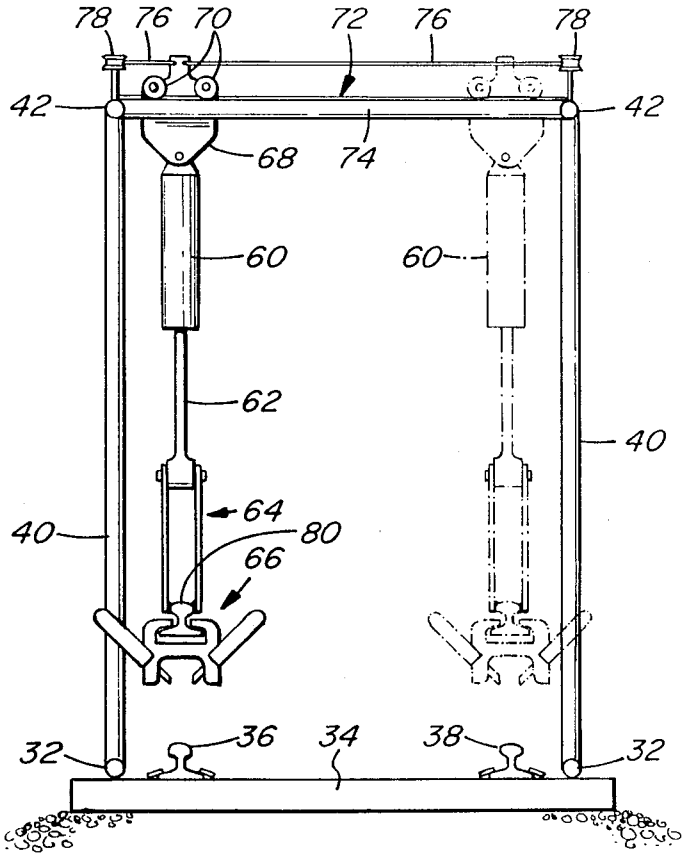
FIG. 3 is a cross-sectional view taken along line 3—3 of FIG. 1.

With reference to FIGS. 1 to 3, frame 12 is comprised of spaced, parallel elongated skids 32 which, as previously mentioned, rest upon and slide along the opposite ends of ties 34 on the outboard sides of rails 36 and 38 to be removed. The skids are constructed of tubular steel such as, for example, three inch diameter oilwell production steel casing. The lower ends of each of a plurality of columns or posts 40 are secured to and extend upwardly from each skid 32 while their upper ends are secured to an upper pipe 42. Braces 44 extend between columns 40 and pipes 42 to impart rigidity to the structure. A plurality of cross-members 46 are secured to and extend between upper pipes 42. Columns 40, pipes 42, braces 44 and cross-members 46 may be constucted of $2\frac{5}{8}$ inch oilwell production casing.

Power equipment 28 mounted at the trailing end of the frame includes an engine 50, such as for example, a 58 hp Ford industrial engine, two hydraulic pumps 52 and 54 and two winches 55 and 56. Pump 52 is arranged to supply hydraulic fluid to two hydraulic cylinders utilized by the rail and tie separating apparatus and pump 54 is arranged to drive the fluid motors of winches employed by the rail elevating apparatus, the separating apparatus, and hydraulic motors utilized by the rail conveyor. For the purposes of the present invention, it has been found that a pump capable of delivering 32 gpm at a pressure of 2400 psi and a speed of 1400 rpm would be appropriate for the pump 52 and that a pump capable of delivering 16 gpm at a pressure of 800 psi and a speed of 1400 rpm would be acceptable for pump 54. The operator's seat is disposed as high as possible and preferrably above the engine and pumps in order to enhance operator visibility.

The rail and tie separating apparatus 20 will now be described with reference to FIGS. 1 and 3 to 5. The rail and tie separating apparatus is comprised of a pair of longitudinally spaced and vertically extending hydraulic, pulling cylinders 60, each having a piston rod 62 whose free end is pivotally secured to an end of an elongated member 64 extending between the two cylinders as shown in FIG. 1. A plurality of rail clamps 66 are mounted on the member 64 for longitudinal sliding movement therealong. The end of each hydraulic cylinder remote from its respective piston rod is pivotally secured to a trolley 68 which includes a pair of rollers 70 arranged to roll along a track 72 formed by an inverted rail 74 extending between and secured to parallel upper pipes 42, as best shown in FIG. 3. A cable 76 is secured to the trolley and is trained back to winch 56 by means of suitable pulleys 78. In this manner, the cylinders can be moved back and forth acoss the frame and thus positioned to remove either of two rails 36 and 38.

Member 64 is constructed in the manner of a trussed beam including a beam 80, formed from a railroad track rail, a strut 82 extending upwardly from the mid-portion of the beam and a pair of rods 84 extending from the upper end of the strut to the opposite ends of the beam. Piston rods 62 are pivotally secured to the opposite ends of the beam by connecting plates 86. A truss construction is preferred in order to minimize deformation of the beam and the rail which is to be removed.

Figure 4:
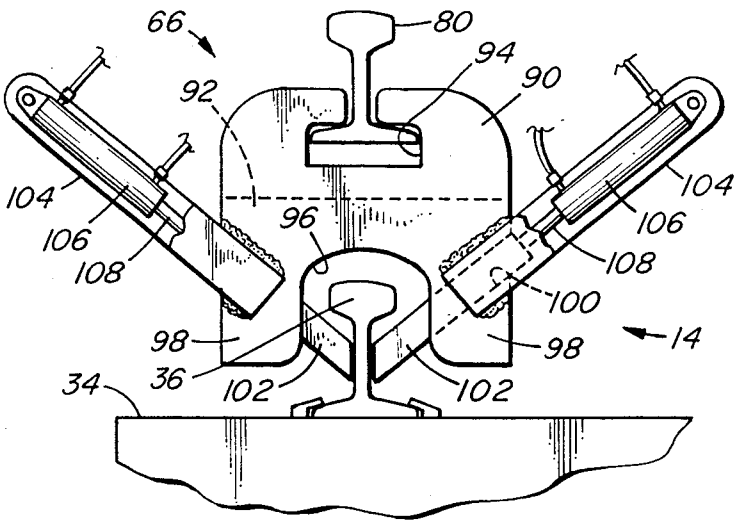
FIGS. 4 and 5 are front and side elevational views of a rail clamp used for gripping a rail to be separated from its associated ties.
Figure 5:
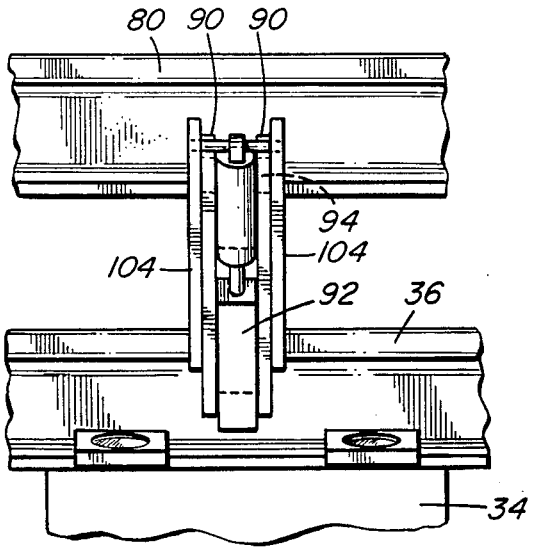

Reference will now be made to FIGS. 4 and 5 which illustrate a rail clamp 66. As previously mentioned, at least three rail clamps 66 are slidably mounted on the beam, one adjacent each end and one in the middle, in order to distribute lifting forces along the length of the rail and thereby avoid bending or twisting of the rail to be removed. A larger number of substantially equally spaced clamps could be used if so desired.

Each clamp includes a pair of $\mu$ inch steel plates 90 which are spaced apart by and welded to a 2 inch steel block 92. The upper ends of plates 90 are formed with aligned generally inverted T-shaped slots 94 shaped to loosely receive the base and a portion of the web of beam 80 so that the clamps can readilly be mounted on, moved along or removed from the beam and accomodate curvature and undulations in the rail to be removed. The lower ends of plates 90 are formed with aligned recesses 96 to receive the head and a portion of the web of a rail to be removed. The recesses define a pair of legs 98. A square opening 100 extends from each recess through each leg upwardly and outwardly at an angle of about 40° to the horizontal. Openings 100 each slidably receive a square puller pin 102 the purpose of which is to releasably engage the web and underside of the head of a rail to be removed. A pair of parallel steel straps 104 are secured to the outer surfaces of legs 98 and extend laterally outwardly and upwardly of each side thereof in alignment with openings 100 for the purpose of supporting double acting hydraulic cylinders 106 whose piston rods 108 are secured to puller pins 102. The piston rods are normally retracted.

When it is desired to grip a rail to be removed, member 64 is lowered over the rail until the rail head seats within recesses 96 of each clamp. Hydraulic cylinders 106 are then pressurized in unison to extend their respective piston rods and puller pins under the rail head of the rail. Upon retraction of piston rods 62 of hydraulic pulling cylinders 60, the pulling pins bear against the underside of the rail heads. The forces thus lock the pins in position and prevent them from moving upwardly in their respective openings. Piston rods 62 are retracted until all of the spikes holding the rail to its respective ties have been removed. The apparatus is then moved laterally inwardly, generally midway in the frame where the rail is dropped by extending piston rods 62 until the rail engages the ground, to relieve the pressure on the puller pins, and retracting piston rods 108 of cylinders 106 to retract the puller pins. The apparatus is then moved to the laterally adjacent rail and the procedure is repeated. Workmen collect the loose spikes and tieplates and place them in their respective bins in the flatcar.

It will be seen from the foregoing that the positioning of the pulling cylinders, the gripping of the rail to be removed, and the removal of the spikes by lifting of the truss beam can not only be readilly accomplished by a single workman, but this is achieved without applying to the rail any torsional or bending stresses which would permanently deform the rail being removed.

Figure 6:
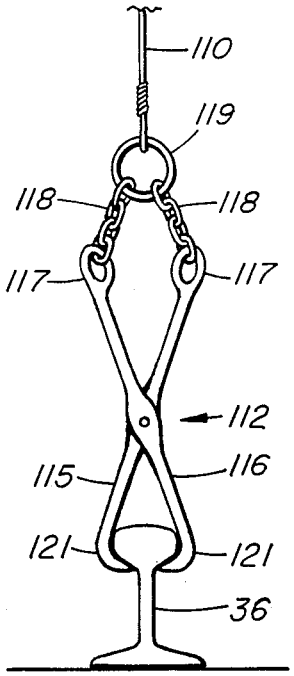
FIG. 6 is a view illustrating rail tongs employed by the rail elevating apparatus.

With reference to FIGS. 1 and 6, the rail elevating apparatus is simply comprised of a pair of cables 110 connected to winch 55 and a pair of tongs 112 secured to the free end of each cable, as shown in FIG. 6. The free ends of the cables and their associated tongs depend from pulleys 114 mounted midway on the top of the frame and are longitudinally spaced apart by a distance which is somewhat less than the length of a rail. Tongs 112 include a pair of arms 115 and 116 pivotally connected to one another whose upper ends 117 are secured to their associated cables by means of a pair of chains 118 and a ring 119. Thus, when cables 110 are untensioned, the tongs can readilly be opened and their lower ends 121 placed over the head of the rail whereas, when the cables are tensioned, the tongs securely grip the rail.

Thus, once a rail has been detached, tongs 112 are positioned over the rail head and the winch is activated so as to raise the rail until it is securely seated in the conveyor. The tension on cables 110 is then released and tongs 112 open and fall off the rail. It will be seen that the task of elevating the rail is quickly and easily effected.

Rail conveyor 24 will now be described with reference to FIGS. 1 and 7 to 10. The conveyor is comprised of three transport wheel assemblies 120, illustrated in FIGS. 7 and 8, the forward two of which are rotatably driven, and a rotatably driven rail discharge wheel assembly 122, illustrated in FIGS. 9 and 10, located at the forward end 14 of the frame. In general, each of the four assemblies includes a wheel mounted pneumatic tire rotatable about an axis extending transversely of the frame and mounted on a support which can be adjusted laterally as well as vertically so that the upper surfaces of the tires can be brought into longitudinal and horizontal alignment with one another. Transport wheel assemblies 120 each include means to hold a rail centered on the tires while rail discharge wheel assembly 122 includes guides for directing the rail onto a rail receiving platform or channel mounted on the flatcar and means for urging the rail into good frictional contact with the rail discharge wheel.

Each of the four wheel assemblies includes a wheel 130 which is rotatably mounted on an inverted J-shaped frame 132 whose upper end 134 is connected to a steel strap 136 for pivotal movement about a longitudinal axis. Strap 136 extends through a longitudinal slot 138 formed in a cross-member 46 of frame 12 while a bolt 140 retains the strap in the slot. The slot is of sufficient length to permit frame 132 to be adjustably positioned transversely of frame 12. The wheels of the two forward most transport wheel assemblies and that of the rail discharge wheel assembly are driven by fluid motors 142, secured to frame 132, via a chain 144 and sprocket 146. The wheels are disposed in a central, vertical, longitudinal plane of frame 12.

Figure 7:
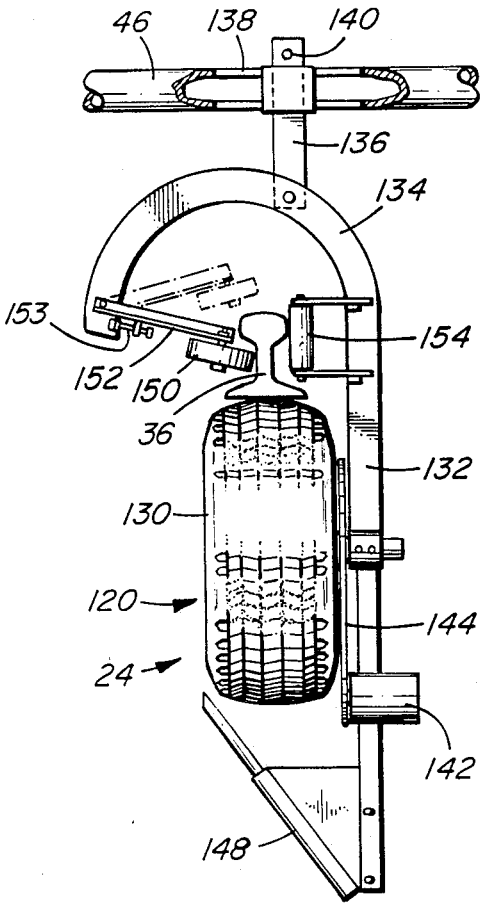
FIGS. 7 and 8 are front and side elevational views of a rail transport assembly employed by the rail conveyor.
Figure 8:
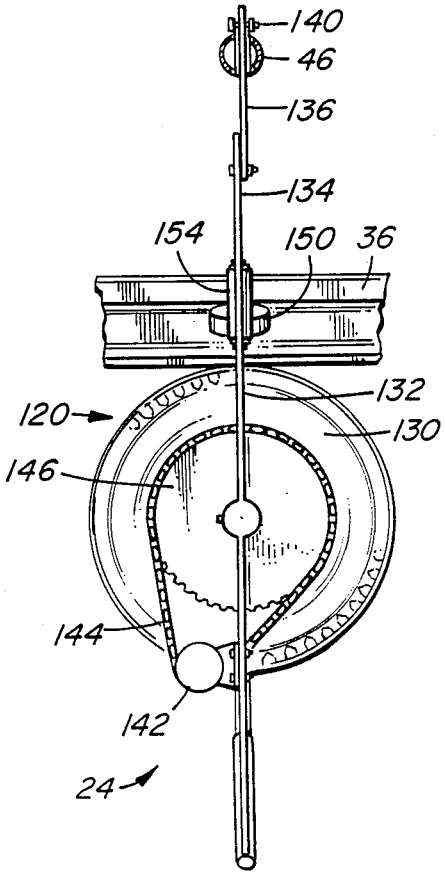
Figure 10:
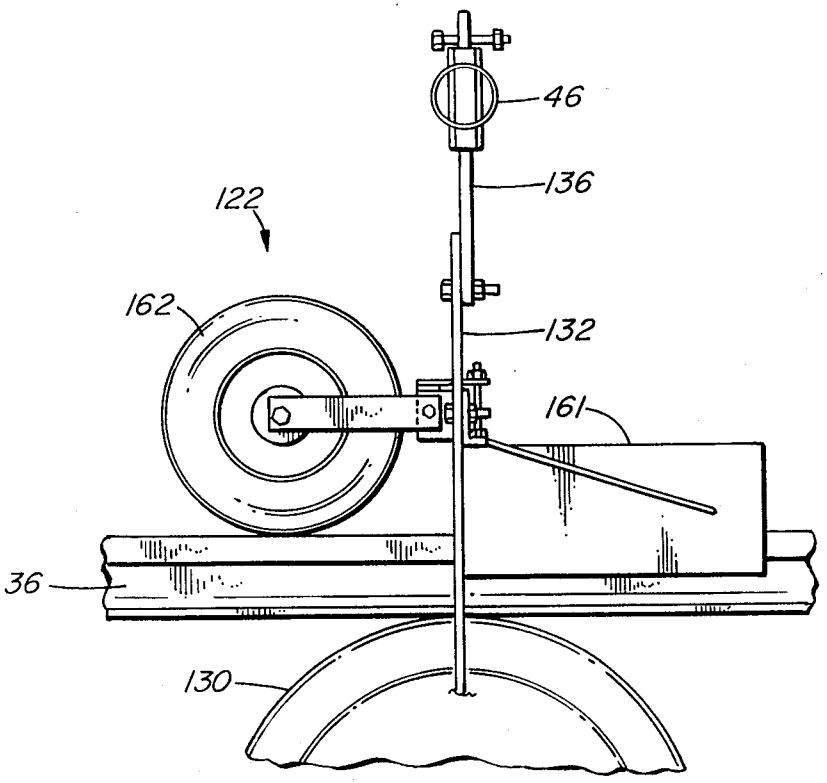
FIGS. 9 and 10 are front and side elevational views of a rail discharge wheel assembly employed by the rail conveyor.
Figure 9:
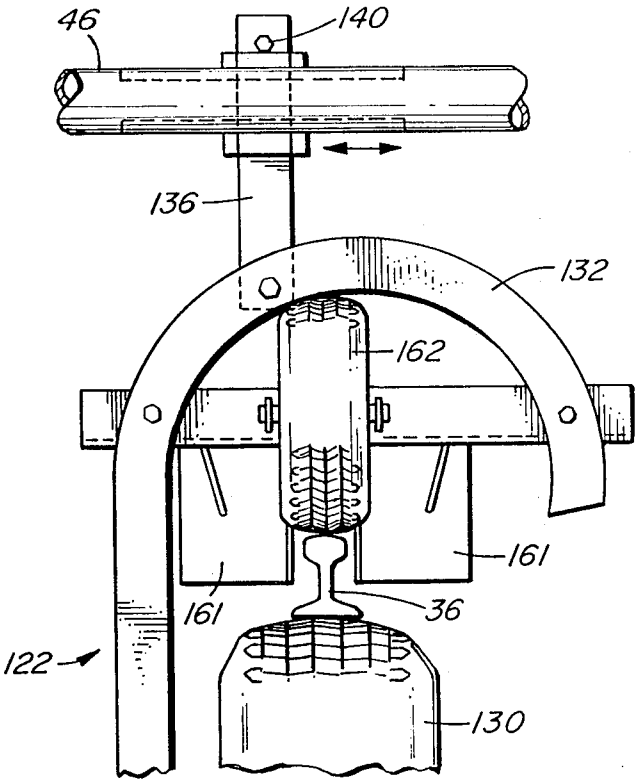

With particular reference to FIGS. 7 and 8, each transport wheel assembly is provided with a rail deflector 148 which is secured to the lower end of frame 132 and extends upwardly and laterally at an angle to frame 132 and beneath wheel 130. As previously mentioned, the rail elevating apparatus elevates the rail along the vertical longitudinal plane of frame 12. Thus, as the rail is elevated, it will engage deflectors 148 and slide laterally to the sides of the wheels and upwardly along the sides until the rail clears the upper ends of the wheels whereat it will swing back inwardly.

A roller 150 is mounted at the free end of an arm 152 whose other end is pivotally secured to the upper free end of frame 132. An adjustable stop 152 secured to frame 132 is provided for maintaining the arm in the solid line position shown in FIG. 7. The arm is movable in a counterclockwise direction from that position to the dotted-and-dashed line position when engaged by a rail being elevated to allow the rail to slide onto the top of the tires. In the solid line position, the roller prevents the rail disposed on the tire from moving laterally to the left as viewed in FIG. 7. A second roller 154 is secured to the frame above wheel 130 for preventing the rail from shifting to the right as viewed in FIG. 7.

Once the rail has been seated on the wheels, motors 142 are actuated, and the rail is advanced toward the forward end of frame 12 and particularly towards the rail discharge wheel assembly.

The rail discharge wheel assembly is mounted at the forward end of a cantilevered portion 160 (see FIG. 1) of frame 12 so that the assembly can be disposed above the flatcar in which the removed rails are collected. Wheel assembly 122 is substantially the same as the transport wheel assemblies except that it does not include deflector 148 and rollers 150 and 154. The assembly includes a pair of guides 161, constructed of steel plate and secured to frame 132, which converge toward one another. An pneumatic tire 162 also secured to frame 132 in vertically opposed relation to tire 130 and serves to urge the rail against tire 130 since additional tractive effort is required by the rail discharge wheel assembly when the latter is the only wheel assembly supporting the rail and it must push the rail along the rail receiving platform on the flatcar.

Figure 14:
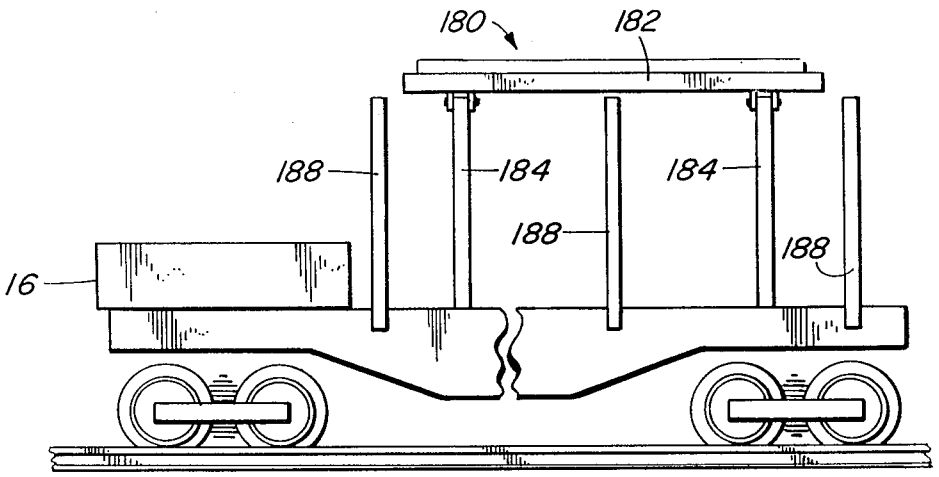
FIGS. 13 and 14 are front and side elevational views illustrating a rail receiving platform mounted on a flatcar on which removed rails are stored.
Figure 13:
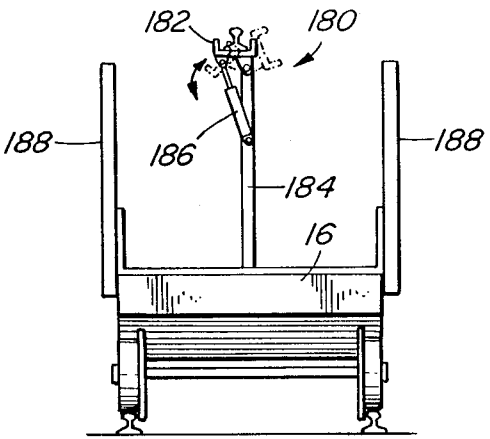

With reference to FIGS. 13 and 14, a rail receiving platform 180 is centrally and longitudinally disposed in the flatcar in alignment with the four aforementioned wheel assemblies. The platform is an elongated, horizontally disposed channel 182 disposed at the same height as and aligned with the the upper surfaces of the row of tires. The channel is pivotally mounted on a number of posts 184 which, in turn, are secured centrally and longitudinally on the flatcar. A hydraulic cylinder 186 connected between the channel member and the posts serves to pivot the channel member between the solid line position and the dotted-and-dashed line positions. When a rail has been deposited on the platform by the rail discharge wheel assembly, the platform is pivoted downwardly on either side of the posts and the rail drops onto the flatcar which is also provided with suitable railing 188 to keep the rails on board.

Figure 12:
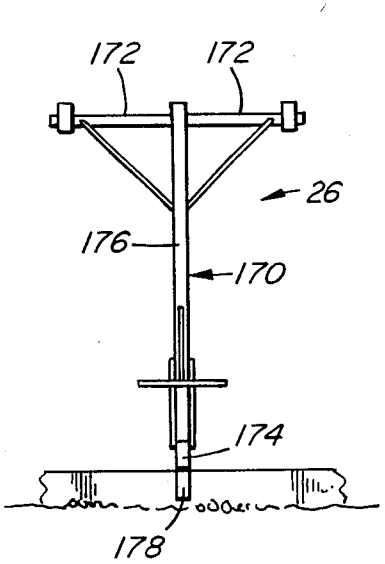
FIGS. 11 and 12 are front and side elevational views of a tie dislodging apparatus.
Figure 11:
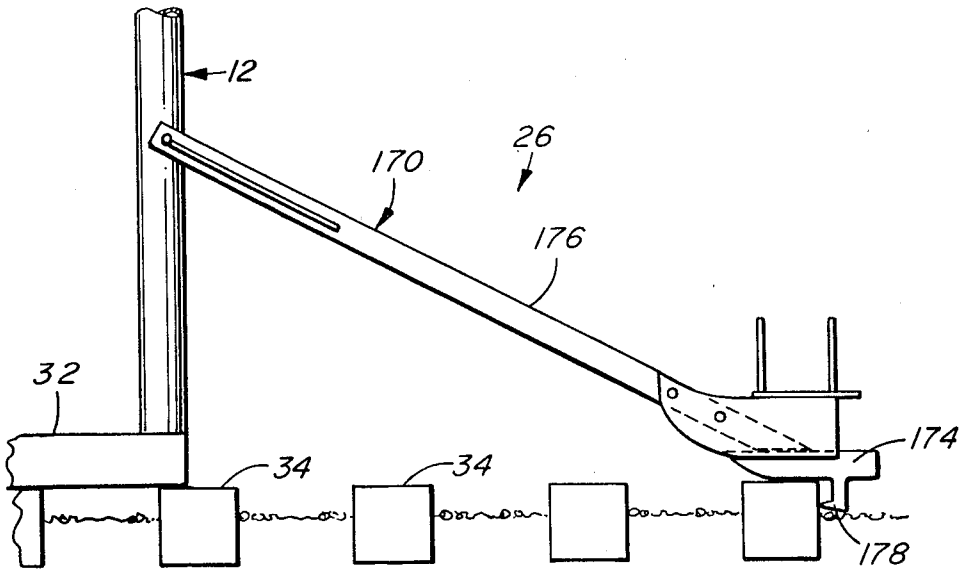

Tie dislodging apparatus 26, illustrated in FIGS. 1, 11 and 12, comprises a T-shaped member 170 having crossarms 172 secured to the trailing end of frame 12 for pivotal movement about a horizontal, transverse axis. A skid 174 is secured to the free end of longitudinal arm 176 and a forwardly projecting hook 178 depends from the skid by a distance which is less than one-half of the depth of a tie. Weights may be added to the top of the skid if desired and depending upon the type of ballast used and the depth of the tie in the road bed. Arm 176 extends downwardly at a slope of about 2 to 1. As the device is towed behind the frame, hook 178 will catch the ties above the centre of the tie and roll it upside down where the tie will be allowed to dry to facilitate the removal of foreign material.

It will be seen therefore that the present invention provides a rail removing apparatus which requires only a relatively small crew and which enables the removal of all steel components at the same time by rail, thus eliminating the need of trucks and loaders and the resulting road damage and inconvenience to the general public, which removes rails without bending or twisting of the rails, and which automatically dislodges ties and turns them upside down to allow them to dry.

It will be understood that various modifications and alterations may be made to the above described invention without departing from the spirit of the appended claims.

The embodiments of the invention in which an exclusive property or privilege is claimed are defined as follows:

1. An apparatus for removing railroad track, comprising:

an elongated frame arranged to straddle a pair of rails and having elongated skids arranged to sit upon the outboard sides of the ends of ties secured to said rails;

rail and tie separating means mounted on said frame for separating a length of rail from the ties to which said length of rail is secured;

rail elevating means for lifting a length of rail which has been separated from its associated ties by said rail and tie separating means; and conveyor means for receiving a length of rail lifted by said elevating means and longitudinally transporting said length of rail to one end of said frame.

2. An apparatus as defined in claim 1, further including means secured to the trailing end of said frame for overturning ties which have been separated from rails as said frame is moved along said track.

3. An apparatus as defined in claim 1, said rail and tie separating means comprising:

means for gripping a rail to be removed at at least three longitudinal spaced positions along said rail, power means connected between said gripping means and said frame for applying an upward force to said gripping means, and means for selectively moving said power means transversely of said frame.

4. An apparatus as defined in claim 1, said rail and tie separating means comprising:

a pair of longitudinally spaced trolleys mounted on an upper portion of said frame for transverse movement thereacross, means for moving each said trolley across said frame, a hydraulic cylinder pivotally secured to and depending from each said trolley, each said cylinder having a linearly extendable and retractable piston rod remote from its associated trolley, beam means extending longitudinally of said frame and secured to the free ends of said piston rods, and rail gripping means mounted on said beam means for releasably gripping a rail to be removed at at least its ends and its mid-portion.

5. An apparatus as defined in claim 4, said beam means being in the form of a truss.

6. An apparatus as defined in claim 4, said rail gripping means including at least three rail clamps, each said rail clamp including a housing arranged to transversely straddle a portion of the head of a rail, a pair of linearly extendable and retractable puller pins mounted on opposite sides of said housing for engaging opposite sides of a rail and for movement along converging paths, and means for selectively extending and retracting said puller pins so as to place said pins into and out of engagement with the web and underside of said rail head of said rail.

7. An apparatus as defined in claim 4, said means for moving said trolleys across said frame including cable and winch means mounted on said frame.

8. An apparatus as defined in claim 1, said rail and tie separating means comprising:

a pair of longitudinally spaced trolleys mounted on an upper portion of said frame for transverse movement thereacross, cable and winch means mounted on said frame for moving each said trolley across said frame, a hydraulic cylinder pivotally secured to and depending from each said trolley, each said cylinder having a linearly extendable and retractable piston rod remote its associated trolley, beam means in the form of a truss extending longitudinally of said frame and secured to the free ends of said piston rods, and rail gripping means mounted on said beam means for releasably gripping a rail to be removed at at least near its ends and its mid-portion;

said rail gripping means including at least three rail clamps, each said rail clamp including a housing arranged to transversely straddle a portion of the head of a rail, a pair of linearly extendable and retractable puller pins mounted on opposite sides of said housing for engaging opposite sides of a rail and for movement along converging paths, and hydraulic cylinder means for selectively extending and retracting said puller pins so as to place said pins into and out of engagement with the web and underside of said rail head of said rail.

9. An apparatus as defined in claim 1, said rail elevating means comprising:

a winch mounted on said frame, cable means connected to said winch, said cable means having a free end portion depending from said frame in a substantially longitudinal vertical plane of said frame, and rail gripping tong means secured to the free end portion of said cable means for releasably gripping the head of a rail to be elevated.

10. An apparatus as defined in claim 8, said cable means including at least two cables secured to said winch, the free end portions of said cables depending from longitudinally spaced positions in said plane, and each said cable having tong means secured to the free end portion thereof.

11. An apparatus as defined in claim 1, said conveyor comprising:

at least three longitudinally spaced rail transport wheel assemblies defining a longitudinal path for directing a rail to the forward end of said frame, each said assembly including a support secured to said frame for pivotal movement about a longitudinal axis, a wheel rotatable about a transverse axis and disposed substantially in a longitudinal vertical plane centrally disposed between said skids of said frame, retaining means adjacent the upper end of said wheel for permitting a rail to be seated on said wheel and preventing said rail to move transversely of said longitudinal axis, deflector means disposed beneath said wheel, and means for rotatably driving at least the forward most one of said wheels, whereby, when a rail is elevated by said elevating means in said vertical plane, said rail engages said deflectors and displaces each said assembly to one side, said rail moves upwardly along the sides of said wheels and said wheels move back under said rail when the height of said rail exceeds the height of the top of said wheels, and said rail is moved longitudinally forwardly by said at least one driven wheel.

12. An apparatus as defined in claim 11, said conveyor further including a rail discharge wheel assembly comprising:

a support secured to said frame for pivotal movement about said longitudinal axis, a first wheel mounted on said support for rotation about a transverse axis being in substantial longitudinal alignment with said wheels of said rail transport wheel assemblies, means for rotatably driving said first wheel about said transverse axis, guide means secured to said support for guiding a rail being transported along said longitudinal axis, and a second wheel secured to said support for rotation about a transverse axis and vertically spaced from said first wheel for applying a downward force to a rail disposed between said first and second wheels and thereby increase the tractive effort between said first wheel and said rail.

13. An apparatus as defined in claim 11, each said wheels being a pneumatic tire.

14. An apparatus for removing railroad track, comprising:

an elongated frame adapted to straddle a pair of rails to be removed and having a pair of parallel, elongated skids arranged to be seated upon and slide along the ends of ties secured to and on the outboard sides of said rails;

a rail and tie separating means mounted on said frame for separating a length of rail from the ties to which said length of rail is secured, said separating means including a pair of longitudinally spaced trolleys mounted on said frame for transverse movement thereacross, means for moving each said trolley across said frame, a hydraulic cylinder pivotally secured to and depending from each said trolley, each said cylinder having a linearly extendable and retractable piston rod, beam means extending longitudinally of said frame and secured to the free ends of said piston rods, and rail gripping means mounted on said beam means for releasably gripping a rail to be removed at at least its ends and its mid-portion;

a rail elevating means for lifting a length of rail which has been separated from its ties by said rail and tie separating means, said elevating means including a winch secured to said frame, a pair of cables connected to said winch and trained about pulleys mounted on said frame, and a rail tongs at the free end of each said cable, the free end of each said cables being arranged to depend from said frame generally midway between said skids and said tongs being longitudinally spaced by approximately the length of a rail to removed; and a conveyor for receiving a length of rail from said elevating means and transporting said length of rail longitudinally to one end of said frame, said conveyor including at least three transport wheel assemblies each suspendedly secured to said frame for pivotal movement about an axis extending longitudinally of said frame, each said assembly including a pneumatic tire rotatable about an axis extending transversely of said frame, said tires being in longitudinal alignment with one another and being disposed in substantially the same vertical plane as that in which a rail is elevated by said elevating means, each said assembly having a deflector for pivotally deflecting its associated assembly about said longitudinal axis upon engagement with a rail being elevated by said elevating means, means for maintaining a rail opearatively positioned on said tires, means for rotatably driving at least the forward ones of said tires and a rail discharge wheel assembly for longitudinally guiding and driving a rail unto rail storage means; and tie dislodging means for dislodging ties from which rails have been separated, an arm connected to the trailing end of said frame for pivotal movement in a longitudinal, central vertical plane, said arm extending downwardly and rearwardly of said frame and having a skid portion at the free end thereof, and a hook depending from and projecting forwardly of said skid, whereby, as said arm is towed behind said frame, said skid rides upon the upper surface of said ties and said hook catches said ties above the center of gravity of said ties, turns them upside down and releases them upon railroad bed.

15. A clamp for use in releasably gripping and lifting a railroad track rail, comprising:

a housing arranged to transversely straddle a portion of the head of a rail, a pair of linearly extendable and retractable puller pins mounted on opposite ends of said housing for engaging opposite sides of a rail and for movement along converging paths, and means for selectively extending and retracting said puller pins so as to place said pins into and out of engagement with the web and underside of said rail head of said rail.

16. A clamp as defined in claim 15, said housing having an inverted T-shaped groove in a first edge thereof arranged to slidingly receive an inverted T-shaped portion of a beam for applying a lifting force to said clamp, a recess in a second edge oppositely disposed from said groove and extending substantially parallel thereto for receiving the head of a rail to be gripped by said clamp, and a pair of passages in said housing for slidingly receiving said puller pins, said passages having one end opening into said second edge adjacent said recess and diverging from one another at a predetermined angle.

17. A clamp as defined in claim 16, wherein the included angle between said passages is about 100°.

18. A clamp as defined in claim 16, said means for selectively extending and retracting said puller pins being a double acting hydraulic cylinder associated with each said puller pin.

19. A railraid tie dislodging apparatus for dislodging ties from a track bed, said apparatus being adapted to be secured to the trailing end of towing means, such as a vehicle, railroad track removing machine or the like, said apparatus comprising:

an arm having one end adapted to be connected to the trailing end of said towing means for pivotal movement about an axis generally paralleling the longitudinal axis of ties to be removed, said arm and having a skid portion at the other free end thereof, and a hook depending from and projecting forwardly of the forward end of said skid, whereby, as said arm is towed behind said frame, said skid rides upon the upper surface of said ties and said hook catches said ties above the center of gravity of said ties, turns said ties upside down and releases them upon railroad bed.

20. A rail conveying assembly for use with a railroad removing machine for transporting separated rails longitudinally of said machine, said assembly comprising:

a frame adapted to be secured to said machine for pivotal movement about a longitudinal axis of said machine, a wheel mounted on said frame for rotation about a transverse axis retaining means adjacent one end of said wheel for permitting a rail to be seated on said wheel and preventing said rail to move transversely of said longitudinal axis, deflector means disposed beneath said wheel, and means for rotatably driving said wheel.

* * * * *